US008797130B2

(12) United States Patent
Stevenson

(10) Patent No.: US 8,797,130 B2
(45) Date of Patent: Aug. 5, 2014

(54) UNIVERSALLY ORIENTABLE SECURITY SWITCH

(75) Inventor: Robert Stevenson, Kalama, WA (US)

(73) Assignee: Royne Industries, LLC, La Jolla, CA (US)

( * ) Notice: Subject to any disclaimer, the term of this patent is extended or adjusted under 35 U.S.C. 154(b) by 0 days.

(21) Appl. No.: 13/605,906

(22) Filed: Sep. 6, 2012

(65) Prior Publication Data

US 2012/0326816 A1 Dec. 27, 2012

Related U.S. Application Data

(63) Continuation of application No. 12/764,816, filed on Apr. 21, 2010, now abandoned.

(60) Provisional application No. 61/171,812, filed on Apr. 22, 2009.

(51) Int. Cl.

| | |
|---|---|
| ***H01H 9/00*** | (2006.01) |
| *H01H 3/16* | (2006.01) |
| *H01H 36/00* | (2006.01) |

(52) U.S. Cl.

CPC ..... *H01H 36/0013* (2013.01); *H01H 3/161* (2013.01); *H01H 36/006* (2013.01); *H01H 36/0046* (2013.01)

USPC ..... 335/205; 335/154

(58) Field of Classification Search

USPC ..... 335/151–154, 205–208

See application file for complete search history.

(56) References Cited

U.S. PATENT DOCUMENTS

| | | | | |
|---|---|---|---|---|
| 4,210,889 | A * | 7/1980 | Holce | 335/207 |
| 4,700,163 | A * | 10/1987 | Wolfe, Jr. | 335/205 |
| 4,945,340 | A * | 7/1990 | Brill | 340/547 |
| 5,668,533 | A * | 9/1997 | Jackson et al. | 340/547 |
| 7,242,297 | B2 * | 7/2007 | Vogt | 340/547 |
| 7,965,160 | B2 * | 6/2011 | Edmonson | 335/207 |
| 2003/0052780 | A1 * | 3/2003 | Buckley | 340/547 |

* cited by examiner

*Primary Examiner* — Bernard Rojas

(74) *Attorney, Agent, or Firm* — Rylander & Associates, PC; Philip R. M. Hunt

(57) ABSTRACT

The magnetic switch assembly of an embodiment generally comprises a switch housing coupled to and/or adjacent to a magnet housing. The switch housing may be coupled to, for example, a door frame, a window frame, or other substantially fixed location. The magnet housing including at least one magnet may be coupled to, for example, a door or other substantially mobile location adjacent to the switch housing. The proximity to or distance from the magnets in the magnet housing may actuate one or more reed switches within the switch housing to open and/or close a circuit and/or otherwise generate a signal that may be communicated to, for example, a security system to detect whether the door is open or closed.

10 Claims, 4 Drawing Sheets

UNIVERSALLY ORIENTABLE SECURITY SWITCH

CROSS-REFERENCE TO RELATED APPLICATION

This application is a continuation of and claims priority to co-pending U.S. Non-provisional application Ser. No. 12/764,816 filed 21 Apr. 2010, which in turn claims priority to U.S. Provisional Patent Application Ser. No. 61/171,812 filed Apr. 22, 2009, all of which are herein incorporated by reference.

FIELD OF THE INVENTION

The present invention relates to magnetic security switches for entrances and exits.

BACKGROUND

Security systems and/or security alarm systems often use magnetic switches attached to doors, windows, and other structures to detect the unauthorized opening and/or manipulation of the door, window, or other structures. However, previous magnetic switch designs have been prone to tampering, have exhibited unacceptable reliability, and/or are inflexible regarding the manner in which the magnetic switch couples to the door, window, or other structure.

Magnetic switches use the detection of a magnetic field and/or the absence of a magnetic field to indicate that a door, window, or other enclosure access has been opened. In its simplest form, a magnetic switch uses permanent magnet mounted to an enclosure access, e.g. a door to a room, and a magnetic sensor, such as a reed switch, to detect the presence or absence of the permanent magnet. If the magnet is detected, then the door is in the expected position. If no magnet is detected, then the door is not in the expected position. This go/no-go signal can be used as an input to an alarm system, automatic monitoring systems, and/or safety interlocks.

The effectiveness of the magnetic switch as an element of a security system may be affected by the alignment of the permanent magnet with the magnetic sensor and the sensitivity of the magnetic sensor. For example, if the permanent magnet is not within the magnetic sensor's reliable detection range when a door is in an expected position, then the magnetic sensor may incorrectly indicate that the door is not in position. Further, a misaligned permanent magnet may inadvertently be within the detection range of the magnetic sensor when the door is not in the expected position and therefore incorrectly indicate that the door is in position (e.g. a partially closed door indicated as fully closed).

SUMMARY AND ADVANTAGES

The magnetic switch assembly of an embodiment of the present invention presents numerous advantages, including: (1) mounting position and orientation flexibility; (2) mounting symmetry to conveniently position interface; (3) tolerance of coarse motion precision; (4) simplicity of construction; and (5) simplicity of mounting.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims.

Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

REFERENCE NUMBERS USED IN DRAWINGS

Figure 1:
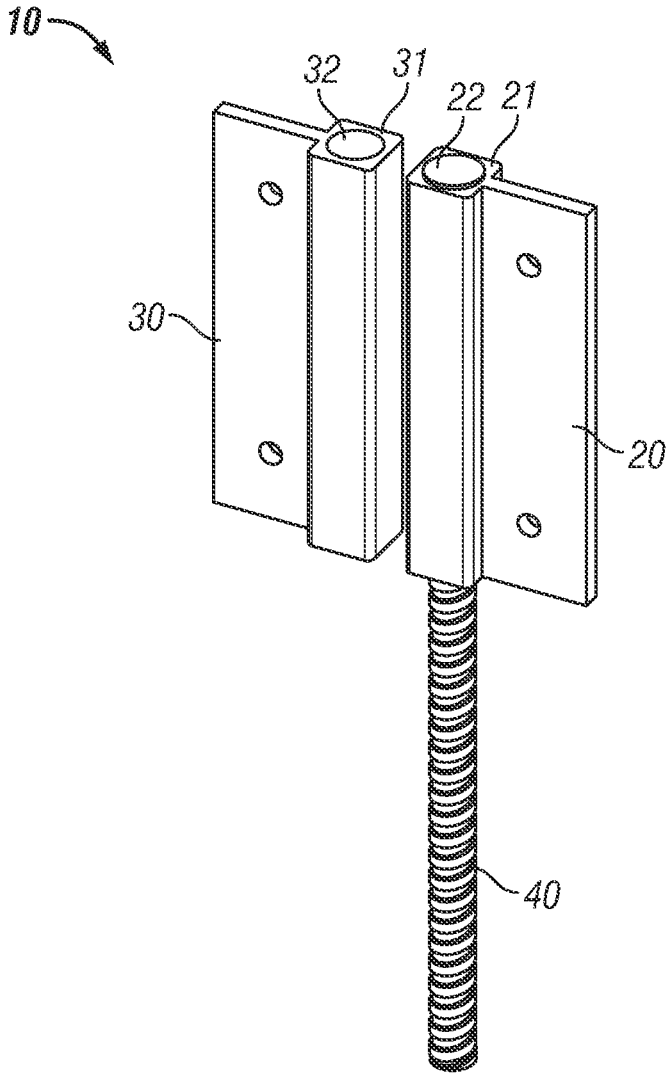
FIG. 1 shows the magnetic switch assembly of an embodiment.

Turning now descriptively to the drawings, in which similar reference characters denote similar elements throughout the several views, the figures illustrate the magnetic switch assembly of the present invention. With regard to the reference numerals used, the following numbering is used throughout the various drawing figures:

10 magnetic switch assembly
20 switch housing
21 switch bore
22 end cap
30 magnet housing
31 magnet bore
32 magnet
40 flex conduit
42 interface
44 reed switch
50 spacer

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

As shown in FIGS. 1-4, a magnetic switch assembly 10 is provided. As illustrated by FIG. 1, magnetic switch assembly 10 generally comprises a switch housing 20 coupled to and/or adjacent to a magnet housing 30. The switch housing 20 may be coupled to, for example, a door frame, a window frame, or other substantially fixed location. The magnet housing 30, including at least one magnet 32 may be coupled to, for example, a door or other substantially mobile location adjacent to the switch housing 20. As will be explained in more detail with reference to FIGS. 2-4, the proximity to or distance from the magnets 32 in the magnet housing 30 may actuate one or more reed switches 44 within the switch housing 20 to open and/or close a circuit and/or otherwise generate a signal that may be communicated to, for example, a security system (not illustrated) to detect whether the door is open or closed. As will further be explained by FIGS. 2-4, the magnetic switch assembly 10 of an embodiment may include one or more features that increase the flexibility with which magnetic switch assembly 10 may be deployed.

Figure 2:
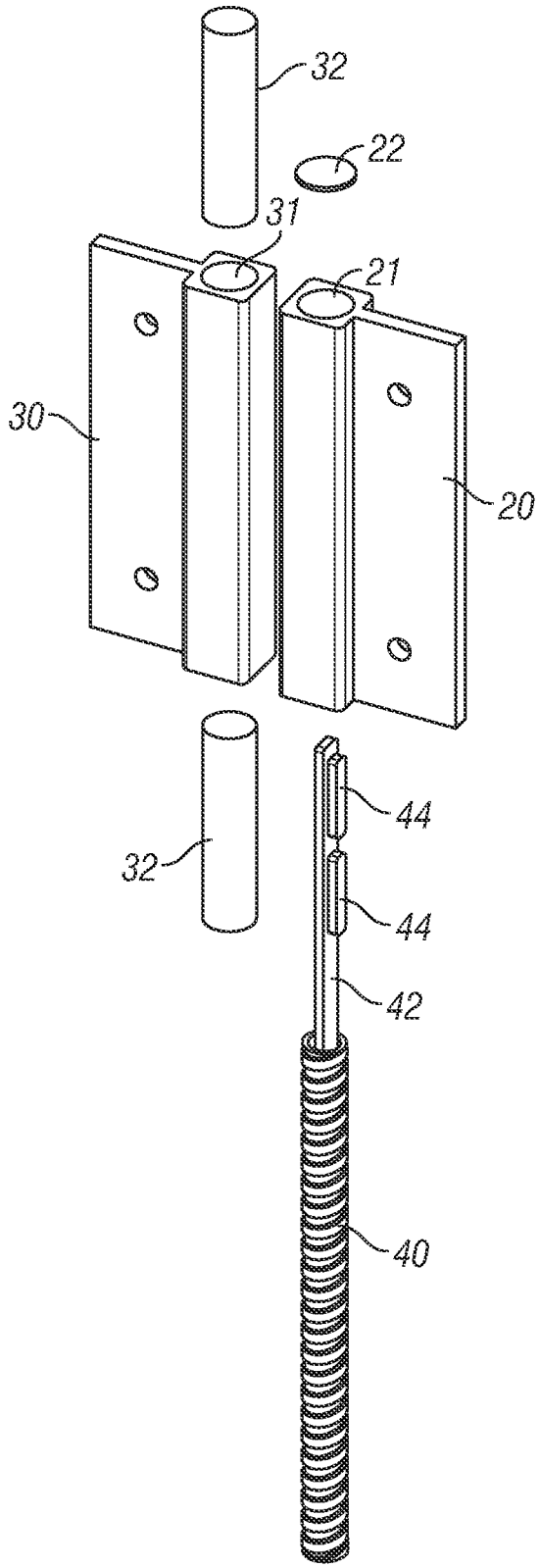
FIG. 2 shows an exploded view of the magnetic switch assembly of an embodiment.

FIG. 2 illustrates an exploded view of the magnetic switch assembly 10 of an embodiment. As noted, the switch housing 20 of an embodiment may include one or more reed switches 44 coupled to interface 42. The interface 42 may couple to, for example, a security system or the like (not illustrated) by way of flex conduit 40. In an embodiment, the switch housing 20 may include two reed switches 44 in switch bore 21 that couple to the interface 42. Generally speaking, reed switches 44 have an approximately cylinder and/or tubular shape with a longitudinal axis that is longer than the cylinder or tube diameter. In an embodiment, the longitudinal axes of the two reed switches 44 may substantially align. Further, the longitudinal axes of the two reed switches 44 may substantially align with the longitudinal axis of the switch bore 21. Said alternatively, the reed switches 44 may be substantially centered in the switch bore 21.

The reed switches 44 of an embodiment may also substantially abut and/or lie adjacent to one another within the switch bore 21. For example, each reed switch 44 may contain a pair (or more) of magnetizable and electrically conductive metal reeds that have end portions separated by a small gap when the switch is open. The reeds are hermetically sealed in opposite ends of a tubular glass envelope from which contacts, conductors, and/or leads may protrude to electrically couple the reed switches 44 with the interface 42, an external circuit, or the like. Accordingly, in an embodiment the tubular glass envelopes of each reed switch 44 may substantially abut and/or lie substantially as close as possible to one another while still permitting access to the contacts, conductors, and/or leads extending from each reed switch 44 at their junction.

Each reed switch 44 of an embodiment may be normally (i.e., in the absence of a magnetic field) open. For such a configuration, the presence of a magnetic field (e.g., as generated by the proximity of magnets 32 included in magnet base 30) may close the reeds within each reed switch 44 to complete a circuit. In an embodiment, multiple reed switches 44 are electrically coupled to the interface 22 in parallel. The magnetic activation of one or more reed switches 44 will, for example, close the circuit coupled to interface 42 and may accordingly be detected by, for example, a security system (not illustrated). The assembly and/or electrical coupling of the reed switches 44 in a parallel circuit may increase the flexibility with which the magnetic switch assembly 10 may be deployed because the magnetic activation of any individual reed switch 44 and/or combinations of multiple reed switches 44 may be detected.

FIG. 2 further illustrates magnet housing 30 of an embodiment including one or more magnets 32. The one or more magnets 32 may have a substantially cylindrical shape and may fit within a magnet bore 31 formed in and/or defined by the magnet housing 30. In an embodiment, the one or more magnets 32 may be neodymium iron boron magnets. Further, for an embodiment including more than one magnet 32, the individual magnets 32 may be aligned so that the north magnetic pole of one magnet 32 couples to the south magnetic pole of another magnet 32. Said alternately, the magnets 32 may align as they would naturally align based on their magnetic attraction.

Figure 3:
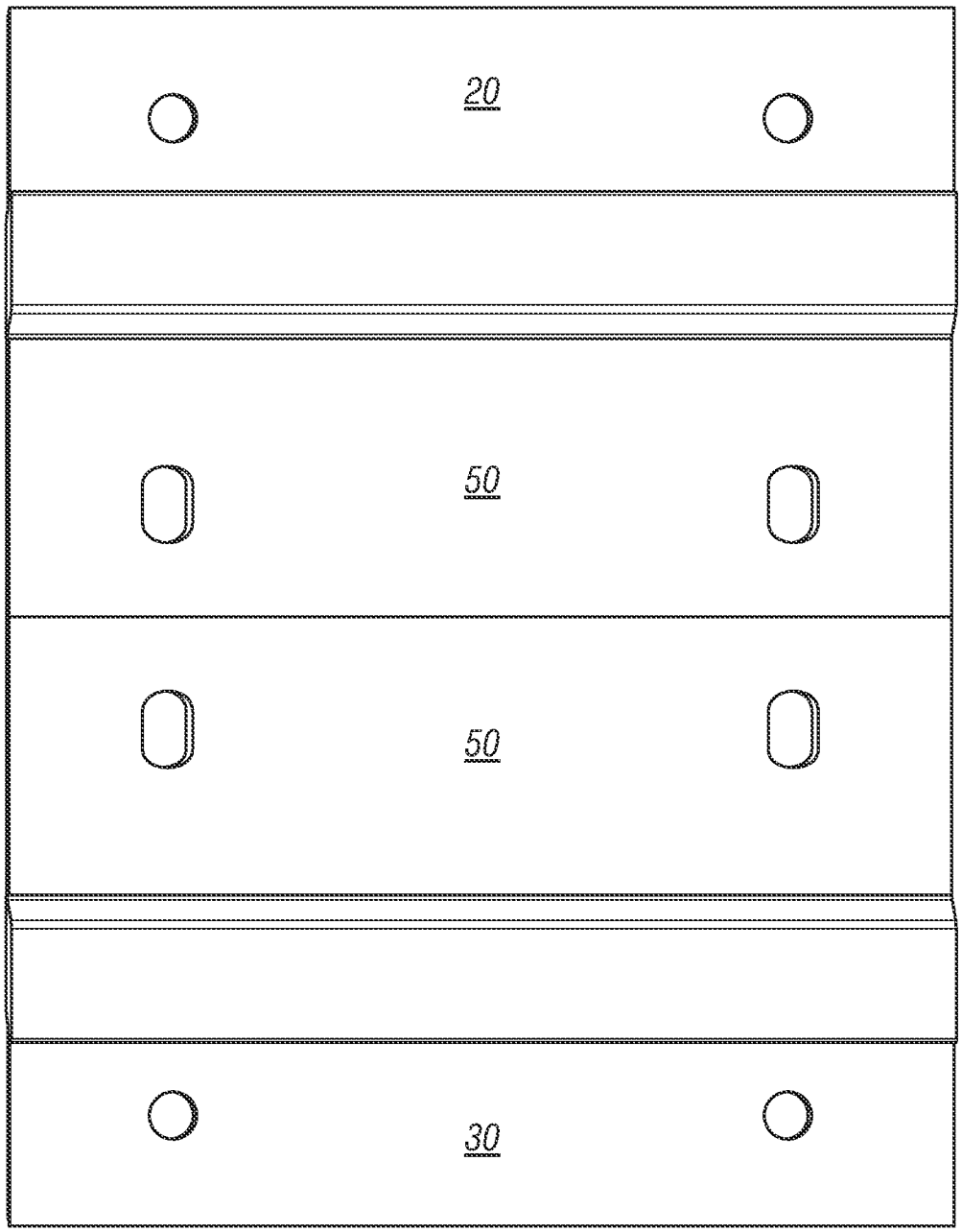
FIG. 3 shows the magnetic switch assembly of an embodiment including mounting plates.
Figure 4A:
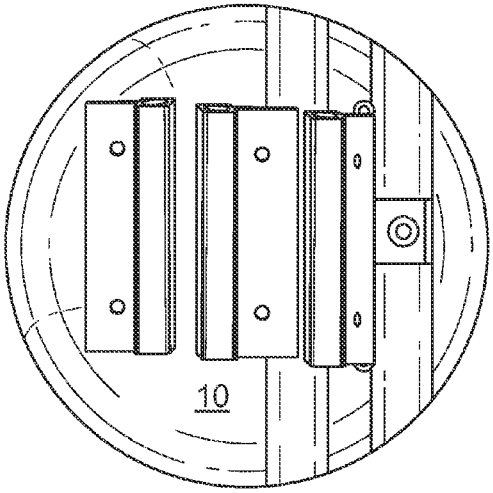
FIG. 4 shows the magnetic switch assembly of an embodiment in a variety of configurations.
Figure 4B:
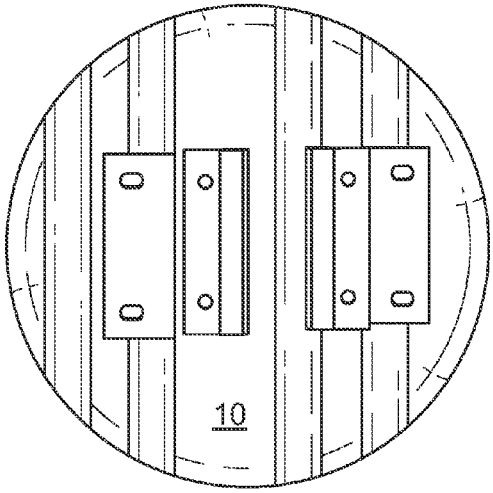
Figure 4C:
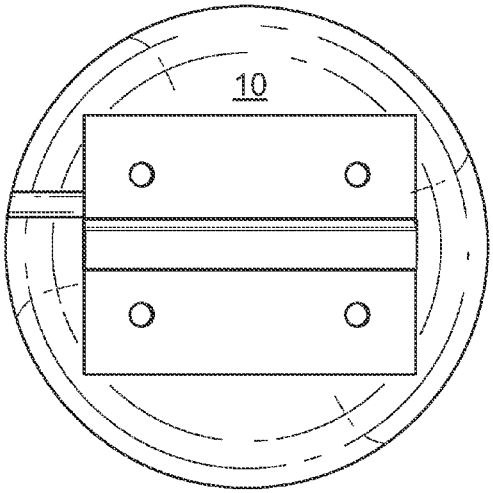
Figure 4D:
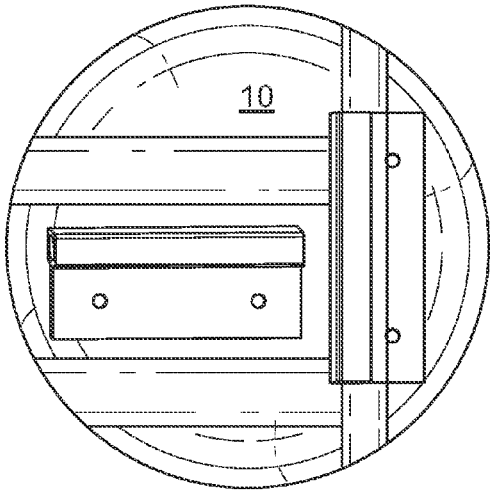

FIG. 3 shows the magnetic switch assembly of an embodiment including spacers 50. The spacers 50 may be inserted between, for example, the switch housing 20 and/or the magnet housing 30 and the surfaces to which the switch housing 20 and/or magnet housing 30 may be mounted. Given the symmetry of both the switch housing 20 and the magnet housing 30, the spacers 50 may be positioned on either side of the switch housing 20 and/or the magnet housing 30 depending on the desired orientation of the switch housing 20 and/or magnet housing 30 once mounted.

FIG. 4 shows the magnetic switch assembly 10 of an embodiment in a variety of configurations. As noted, the assembly and/or electrical coupling of the reed switches 44 in a parallel circuit may increase the flexibility with which the magnetic switch assembly 10 may be deployed. More specifically, the switch housing 20 and the magnet housing 30 may be positioned and/or oriented in a variety of ways relative to each other depending on the magnetic switch assembly 10 application. For example, while the switch housing 20 and magnet housing 30 are adjacent, there may be substantially be no dead spots and/or configurations for which the switch housing 20 fails to detect the magnet housing 30 in error.

For example, as illustrated both the switch housing 20 and the magnet housing 30 have an approximately square cross section in the portion including and/or defining the switch bore 21 and the magnet bore 31 respectively. Further, the switch bore 21 and the magnet bore 31 are substantially centered in the approximately square cross sections. Accordingly, the strength and profile of the magnetic field generated by one or more magnets 32 along each facet of the magnet housing 30 may be substantially similar. The sensitivity of the reed switches 44 along each facet of switch housing 20 may also be substantially similar. As a result, each facet of the switch housing 20 may be substantially similarly responsive to each facet of the magnet housing 30.

Additionally, the strength and profile of the magnetic field generated by one or more magnets 32 along each facet of the magnet housing 30 may be substantially symmetrical. The sensitivity of the reed switches 44 along each facet of switch housing 20 may also be substantially symmetrical. As a result, in addition to the various configurations for which a facet of the switch housing 20 is adjacent a facet of the magnet housing 30, either housing may be flipped without substantially altering the operation of the magnetic switch assembly 10 of an embodiment. More specifically, if a specific magnetic switch assembly 10 application requires that the flex conduit 40 including interface 42 extend from the switch housing 20 in a particular direction, the switch housing 20 may be flipped substantially without interfering with the magnetic switch assembly 10 operation.

Further still, as the actuation of only one of the reed switches 44 may be detected, the magnet housing 30 position and/or orientation may be further modified For example, FIG. 4 illustrates the magnet housing 30 rotationally offset from the switch housing 20. More specifically, the magnet bore 31 of the magnet housing 30 may be substantially perpendicular to the switch bore 21 of the switch housing 20. Alternatively and/or additionally, as only one reed switch 44 needs to be activated and/or triggered by a magnet 32, the alignment (e.g., translational, rotational, and the like) of the switch housing 20 with the magnet housing 30 of an embodiment may or may not be highly precise. For example, with the flexibility offered by the magnetic switch assembly 10 of an embodiment, the magnet housing 30 may be mounted on a mobile object, platform, and/or device whose motion, while substantially repeatable, may nevertheless exhibit a coarseness incompatible with less tolerant magnetic switch assembly designs.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A magnetic switch assembly, comprising:

a switch housing with a body having a square cross-section orthogonal to a longitudinal axis of the switch housing, the body of the switch housing having four longitudinal facets;

a cylindrical bore in the switch housing centered in the square cross-section of the body of the switch housing;

a reed switch assembly inserted in the cylindrical bore of the switch housing;

a magnet housing with a body having a square cross-section orthogonal to a longitudinal axis of the switch housing, the body of the magnet housing having four longitudinal facets;

a cylindrical bore in the magnet housing centered in the square cross-section of the body of the magnet housing; and a cylindrical magnet assembly inserted in the cylindrical bore of the magnet housing.

2. The magnetic switch assembly of claim 1, wherein the cylindrical magnet assembly has one or more cylindrical magnets, each with poles on cylinder ends, the one or more cylindrical magnets aligned in polarity.

3. The magnetic switch assembly of claim 1, wherein the cylindrical magnet assembly extends for substantially an entire length of the magnet housing.

4. The magnetic switch assembly of claim 1, wherein the reed switch assembly has one or more reed switches coupled to a switch assembly interface.

5. The magnetic switch assembly of claim 4, wherein the reed switch assembly extends for substantially an entire length of the magnet housing, with sufficient number and density of reed switches so that when any pole end of the cylindrical magnet assembly is placed adjacent to any facet of the switch housing, at least one of the reed switches is activated.

6. The magnetic switch assembly of claim 1, wherein the one or more reed switches each have a longitudinal axis; and the reed switch assembly is configured so the longitudinal axes of the reed switches substantially align with the longitudinal axis of the switch housing.

7. The magnetic switch assembly of claim 1, wherein the cylindrical reed switch assembly is detachably insertable in either longitudinal end of the cylindrical bore of the switch housing.

8. The magnetic switch assembly of claim 1, wherein the switch housing has a mounting tab that intersects a longitudinal middle of one of the facets of the body of the switch housing.

9. The magnetic switch assembly of claim 1, wherein the magnet housing has a mounting tab that intersects a longitudinal middle of one of the facets of the body of the magnet housing.

10. The magnetic switch assembly of claim 1, wherein the reed switch assembly has substantially symmetrical sensitivity along each facet of the switch housing.

* * * * *